US005922289A

United States Patent [19]

Wong

[11] Patent Number: 5,922,289

[45] Date of Patent: Jul. 13, 1999

[54] MICROTITRATION TRAY

[75] Inventor: Johnson N. S. Wong, Rolling Hills, Calif.

[73] Assignee: Evergreen Industries Inc., Los Angeles, Calif.

[21] Appl. No.: 08/985,930

[22] Filed: Dec. 5, 1997

[51] Int. Cl.[6] ..... B01L 3/00; B01L 9/06

[52] U.S. Cl. ..... 422/102; 422/58; 422/99; 422/104

[58] Field of Search ..... 422/58, 99, 102, 422/104

[56] References Cited

U.S. PATENT DOCUMENTS 4,577,760 3/1986 Rainin et al. ..... 206/508

5,419,278 5/1995 Carter ..... 117/206

5,589,137 12/1996 Markin et al. ..... 422/104

*Primary Examiner*—Jill Warden

*Assistant Examiner*—Alexander Markoff

*Attorney, Agent, or Firm*—Fulbright & Jaworski

[57] ABSTRACT

A microtitration tray for carrying a plurality of frangibly-collected multi-well linear strips in circular apertures therefore, in which the effective diameter of the aperture is reduced by a plurality of symmetrically projecting protuberances, such as ribs, so as frictionally retain the wells in the apertures while enabling ready release of the wells therefrom.

14 Claims, 3 Drawing Sheets

MICROTITRATION TRAY

BACKGROUND OF THE INVENTION

Microtitration trays and frangibly-connected multi-well strips for use in such trays are well-known. See, for example, Lyman et al. U.S. Pat. No. 5,110,556 for "Multi-Well Test Plate", and Verwohlt et al. U.S. Pat. No. 5,514,343 for "Microtitration System." The tray in Lyman et al. is an open tray with no apertures for the wells. The tray of Verwohlt et al. has elongated double well apertures with opposing retention members. Other configurations such as in Thorn et al. U.S. Pat. No. Re 34,133 include trays in which the compartments are defined by rows and columns of posts upstanding from the tray.

In a common modern form of a microtitration tray, the tray is formed with a plurality of circular apertures in a top panel in which are placed arrays of wells, frangibly-connected into a series of strips so that each strip contains a linear array of a plurality of wells. The wells can be cylindrical but often frustoconical in shape wherein a lower portion of the well is smaller in diameter than the aperture in the tray while the diameter of an upper portion is progressively larger until it binds with the tray for a friction fit. An advantage of such a combination of circular apertures and frustoconical wells is the ability of the tray to securely constrain the wells against movement during various operations. If the well is cylindrical, then it will be somewhat loose in the tray aperture or will require a very fine manufacturing tolerance to be close fit to the aperture.

These problems are solved with a frustoconical well. However, while solving one problem, another problem is introduced and that is the inability of such wells to be readily released from the tray. This is particularly troublesome with wells that are frangibly connected to form a linear, multi-well strip. Such strips typically contain eight wells and when it is desired to remove the strip, the strong frictional engagement of each of the eight wells results in a cumulative retention effect making it very difficult to easily remove the strip without the danger of breaking the frangible connection of one or more wells.

SUMMARY OF THE INVENTION

The present invention provides a simple, but elegant solution to the foregoing problems. A microtitration tray is provided for carrying a plurality of frangibly connected multi-well linear strips in which the apertures are circular and the wells are frustoconical in shape. In accordance with the invention, the wells are frictionally retained in the tray but readily releasable from the tray by having a plurality of small protuberances projecting from the material of the tray into the apertures.

In general terms, the projection of at least one protuberance into each aperture decreases the effective size of the aperture so that only the bottom portion of the respective frustoconical well can be inserted therein without engagement whereas the protuberances thereupon engage the upper portion of the frustoconical well. While the wells are sufficiently frictionally engaged by the protuberances to be retained in the tray, because the protuberances are very small, generally one-twentieth of the diameter of the aperture only a small amount of force is required to loosen the wells so that they are easily removed from the tray without destruction of the frangible connections between the wells.

More particularly, a microtitration tray is provided for carrying a plurality of multi-well linear strips in which the wells in each strip are frangibly connected together. Again, the tray has a top wall defining a plurality of substantially circular apertures for releasibly receiving the wells therein, each well having a frustoconical shape. The diameter of each aperture is greater than the largest diameter of the wall to be received therein. To retain the wells in the tray, the top wall is formed with a plurality of ribs symmetrically projected into each aperture. While the effective diameter of the aperture is greater than the diameter of a lower portion of the well, it is smaller than the diameter of an upper portion thereof. As a result, the well is frictionally retained in the tray but readily releasable from the tray. In further particular embodiments, the ribs extend substantially the thickness of the top wall of the tray, the diameter of each rib, normal to the plane of the tray is less than one-twentieth of the diameter of the aperture. In a specific embodiment, four ribs symmetrically project into each aperture.

DETAILED DESCRIPTION OF THE INVENTION

Figure 1:
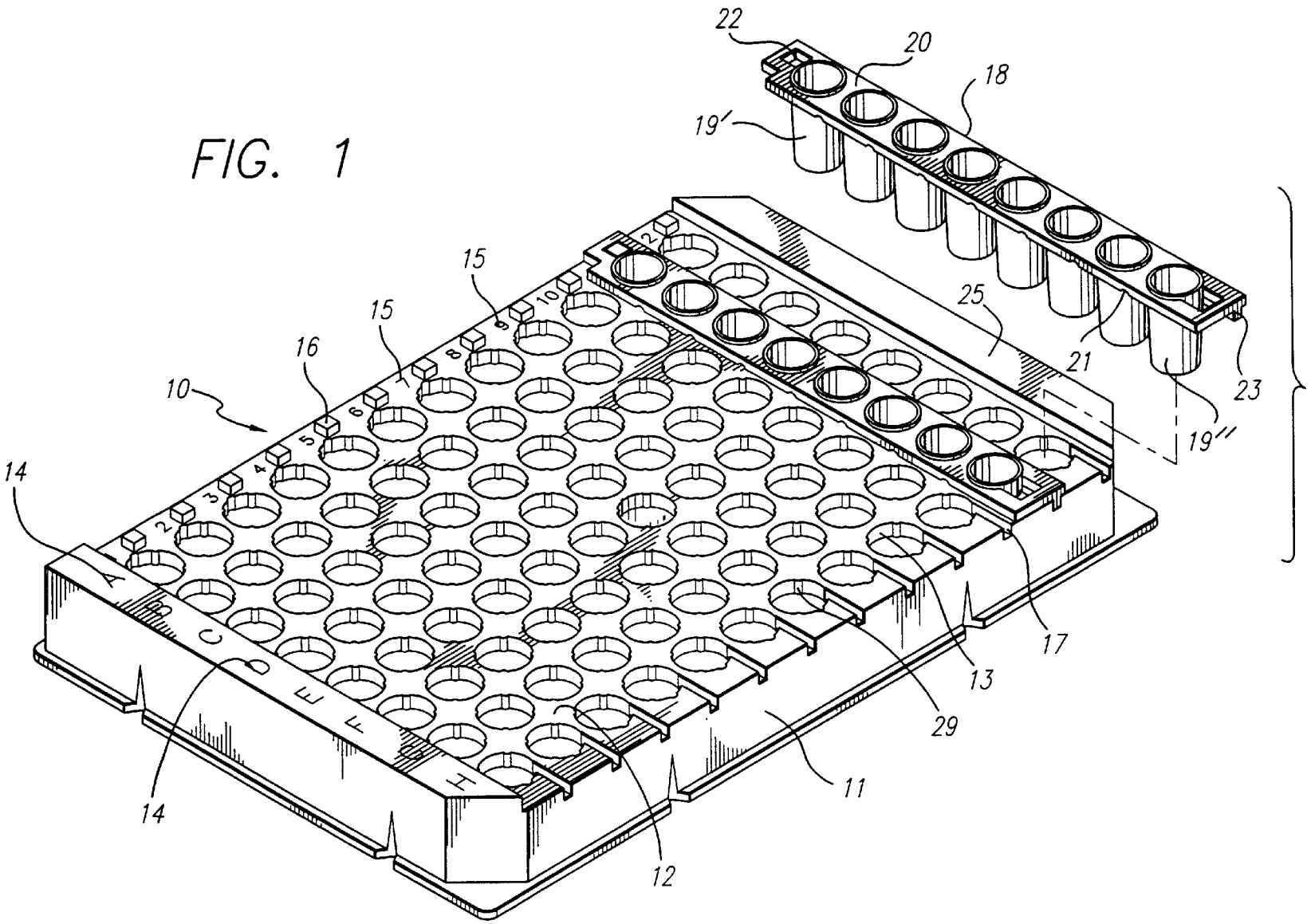
FIG. 1 is a perspective, partially exploded view of a microtitration tray formed to contain 12 multi-well linear strips, each strip containing eight wells, only two strips being shown for clarity of illustration.
Figure 2:
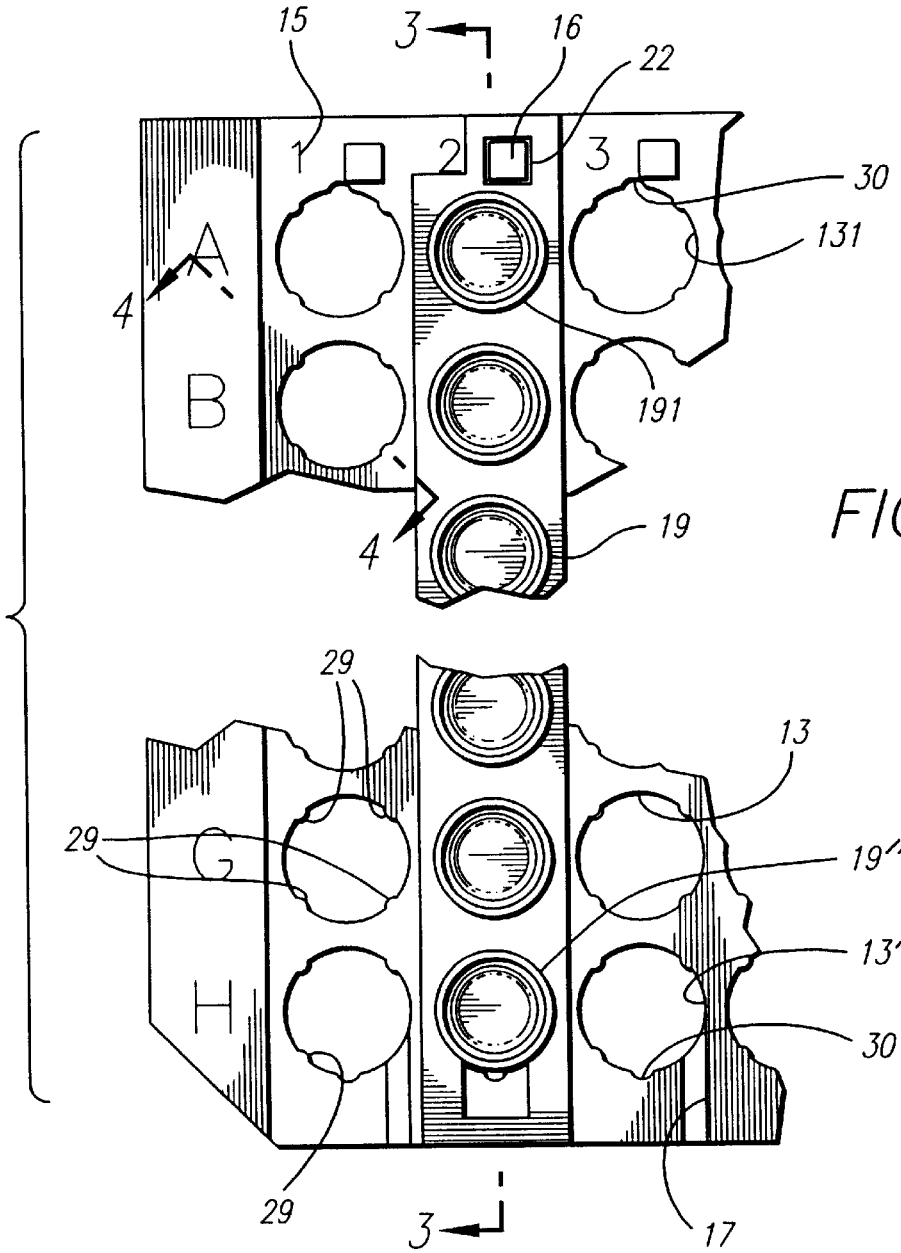
FIG. 2 is a top plan view of an edge portion of the tray at FIG. 1, broken away in various sections.

Referring to FIGS. 1 through 4, a microtitration tray of the present invention comprises a substantially rectangular frame-like holder or tray 10 which is formed integrally from a suitable plastic material, such as a polymeric or copolymeric plastic material, for example, high impact polystyrene, or ABS. The holder 10 is rectangular and comprises a frame 11 defining the sides of the holder 10 and a flat top wall 12 extending across the frame 11. The flat wall 12 defines a plurality of well receiving openings or apertures 13 therein. These openings or apertures 13 are ranged in two sets of parallel rows extending at mutually right angles. The rows in the first set of these rows are identified by consecutive letters A–H on the frame 11, as indicated at 14, while the rows in the second set of these rows are identified by consecutive numbers 1–12, as indicated at 15. Rectangular posts 16 and slots 17 on opposite sides of the numbered rows are used as locating keys as will be described hereinafter.

Also shown in FIG. 1 are two multi-well linear strips 18. Each strip 18 is formed from eight wells 19, each frangibly connected to its neighbor through a common strip panel 20, separated from each other by a line of weakness 21 formed as an indentation into the bottom surface of the strip panel 20. The wells 19 are thereby frangibly connected together and easily broken apart from each other at the lines of weakness 21.

The opposite sides of strip panel 20, adjacent the end wells 19' and 19", have associated with them keying structure. As viewed in FIG. 1, the end of the strip panel 20 adjacent the well 19' is formed with a rectangular aperture 22 which fits over and thereby keys to one of the rectangular posts 16. The other end of the strip panel 20, adjacent well 19", is formed with a lug 23 to lock with the slot 17.

Figure 4:
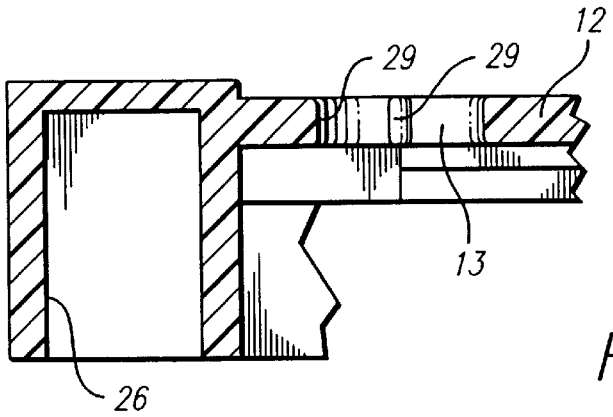
FIG. 4 is a cross-sectional view on line 4—4 of FIG. 2, in the direction of the arrows.

In this particular embodiment, as more particularly shown in FIG. 4, the side 24 containing the letters 14 thereon and the side 25 opposite thereto are each formed with an internal box-like structure 26, for mounting on a particular platform (not shown).

The microtitration tray, as described thus far, is quite similar in construction to modern, commonly available trays except that the apertures 13 are very slightly larger in diameter than the apertures of common trays so that its diameter is slightly larger than the largest diameter of the well 19 to be inserted therein.

Figure 3:
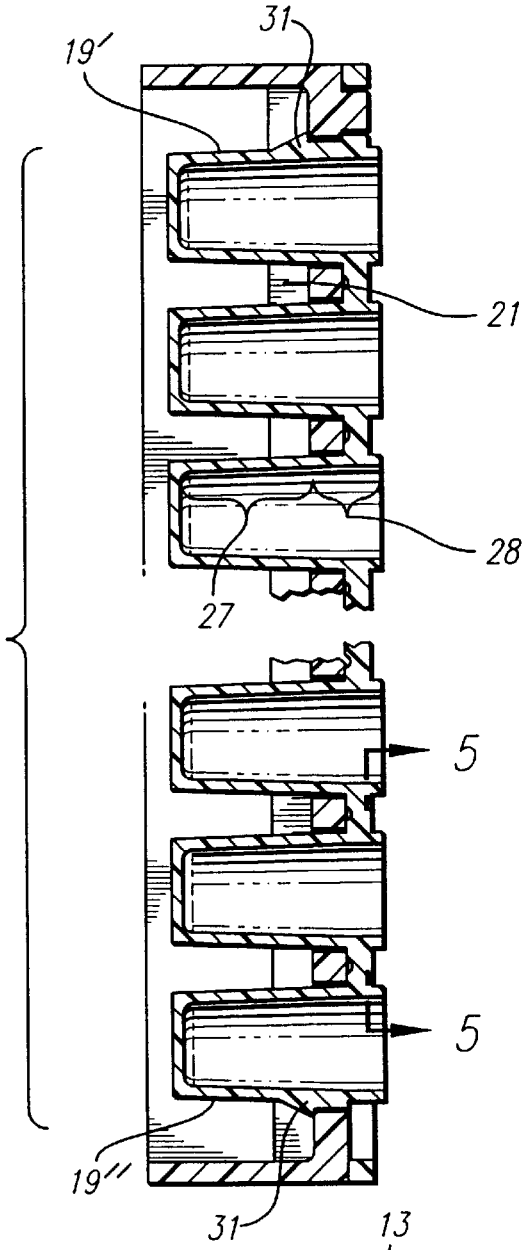
FIG. 3 is a cross-sectional view on line 3—3 of FIG. 2, in the direction of the arrows.

As shown in FIG. 3, each well 19 is of frustroconical shape so that its lower portion 27 is smaller in diameter than its upper portion 28. In accordance with the present invention, and referring particularly to FIGS. 4 and 5, a plurality of protuberances 29 (shown in the Figures in exaggerated dimension for clarity) are formed to project into the aperture 13. It is preferred, as illustrated in this embodiment, to have a symmetrical plurality of protuberances 29. In this particular embodiment, there are four such protuberances 29 in most of the apertures. An exception is with respect to the end apertures of each numbered linear row, such as aperture 13' and 13" in FIG. 2. In such end apertures, there is an indentation 30 adjacent to the respective end walls which accommodates a keying lug 31 on the outer ends of the end wells 19' and 19". Additionally, of the apertures adjacent the wall containing the slot 17 is interrupted by the slot 17 so that there is no protuberance at such interruption. As shown in FIG. 1 and FIG. 4, each protuberance 29 is in the form of a rib extending substantially the thickness of the top wall 12 of the tray.

Figure 5:
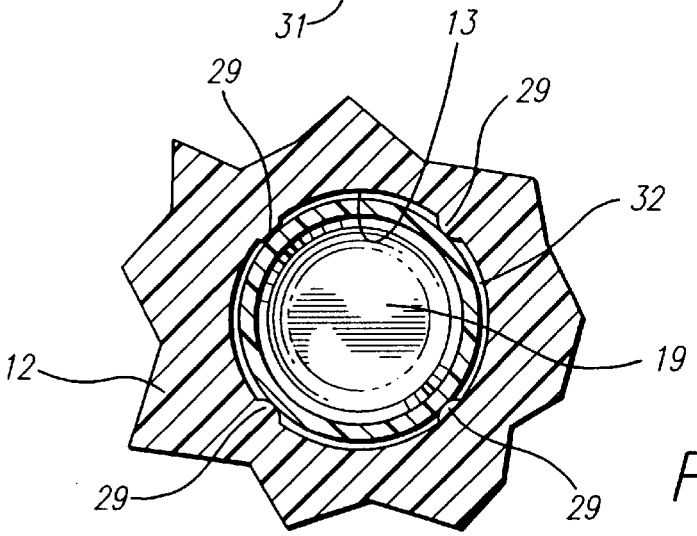
FIG. 5 is a cross-sectional view on line 5—5 of FIG. 3, in the direction of the arrows.

The ribs 29 frictionally engaged the frustoconical side of the titration well 19, securely retaining it in the aperture 13. As shown in FIG. 5, the aperture 13 is sized so that at the region of engagement the protuberance or rib 29, there is a small clearance 32 between the side of the well 19 and the side of the tray 12 defining the aperture 13. It is this clearance, broken only by the contact of the well 19 with the rib 29 then enables the well 19 and multi-well linear strips 18 to be easily released from the tray 10. The protuberances or ribs 29, having lateral widths less than one-twentieth of the diameter of the aperture, exerts sufficient frictional force on the wells 19 to retain them and secure them while the tray is being handled, but they do not provide sufficient frictional force to prevent the readily release of the wells 19 and multi-wells, linear strips 18. The strips 18 are easily removed by pushing upwardly on the bottom of the wells 19.

While a preferred embodiment of the invention has been described, it will be appreciated that variations of the invention will be perceived by those skilled in the art, which variations are nevertheless within the scope of the invention as defined by the claims appended hereto.

I claim:

1. In combination a microtitration tray and at least one multi-well strip, said tray having a top wall defining a plurality of apertures for releasable receiving wells of said at least one multi-well strip therein, each of said wells having a frustoconical shape, the size of each aperture being greater than the largest diameter of the well to be received therein, said top wall being formed with a plurality of protuberances, at least one protuberance projecting into each aperture whereby the effective size of said aperture is greater than the diameter of a lower portion of said well but is smaller than the diameter of an upper portion thereof so as to frictionally retain said wells in said tray while enabling ready release of said wells from said tray.

2. The combination of claim 1 in which each aperture is substantially circular.

3. The combination of claim 1 wherein each protuberance extends the thickness of said top wall.

4. The combination of claim 3 which said protuberance is in the form of a rib.

5. The combination of claim 1 in which the thickness dimension of each protuberance, normal to the top plane of the tray, is less than one-twentieth of the diameter of the aperture.

6. The combination of claim 1 in which a plurality of protuberances project into each aperture.

7. The combination of claim 6 in which the protuberances in each aperture are arranged symmetrically therein.

8. The combination of claim 6 in which there are four (4) protuberances extending into each aperture.

9. The combination of claim 1 in which said at least one multi-well strip comprises a plurality of multi-well strips.

10. The combination of claim 1 in which said wells of said at least one multi-well strip are frangible connected together to constitute said strip.

11. In combination a microtitration tray and a plurality of multi-well linear strip in which the wells in each strip are frangibly connected together, said tray having a top wall defining a plurality of substantially circular apertures for releasable receiving the wells therein, each well having a frustoconical shape, the diameter of each aperture being greater than the largest diameter of the well to be received therein, said top wall being formed with a plurality of ribs symmetrically projecting into each aperture whereby the effective diameter of said aperture is greater than the diameter of a lower portion of said well but is smaller than the diameter of an upper portion thereof so as to frictionally retain said well in said tray while enabling ready release of said well from said tray.

12. The combination of claim 11 in which there are four ribs per aperture.

13. The combination of claim 11 in which each rib extends dimension the thickness of the top wall of the tray.

14. The combination of claim 11 in which the thickness of each rib, normal to the plane of the tray, is less than one-twentieth of the diameter of the aperture.

* * * * *